United States Patent [19]

Pangle

[11] 4,364,142

[45] Dec. 21, 1982

[54] BODY SQUEEGEE

[76] Inventor: Randy L. Pangle, 163 S. Elm, Manteno, Ill. 60950

[21] Appl. No.: 212,269

[22] Filed: Dec. 3, 1980

[51] Int. Cl.[3] ..... A46B 15/00; A46B 17/08

[52] U.S. Cl. ..... 15/117; 15/111; 15/121; 15/245; 15/236 R; 119/90; 128/62 R

[58] Field of Search ..... 15/245, 236, 117, 105, 15/121, 111; 128/62 R, 67, 304; 119/90, 83, 88, 86, 89

[56] References Cited

U.S. PATENT DOCUMENTS

| | | | |
|---|---|---|---|
| 227,362 | 5/1880 | Judson | 119/90 |
| 334,198 | 1/1886 | Sanford | 119/90 |
| 697,336 | 4/1902 | Hagerty | 128/304 |
| 1,591,565 | 7/1926 | Schaffert | 15/117 |
| 2,188,114 | 1/1940 | Hubbard | 15/245 |
| 2,489,483 | 11/1949 | Czapar, Jr. | 15/245 |
| 2,591,301 | 4/1952 | Schacht | 15/245 |
| 3,091,791 | 6/1963 | Czapar, Jr. | 15/245 |

*Primary Examiner*—Peter Feldman

*Attorney, Agent, or Firm*—Leydig, Voit, Osann, Mayer & Holt, Ltd.

[57] ABSTRACT

An improved body squeegee for removal of excess water ancillary to towel drying which includes an elongated handle portion and an elongated generally elliptic head portion with at least one side of the head portion having an inset peripherally extending resilient and flexible blade of rubber like material. The central portion of the head is preferably a recessed spoon shape and the upper peripheral surface of the head is substantially flat. The resilient and flexible blade projects outwardly from the head member at an acute angle presenting a sharp and distinct edge but with the rubber like material being sufficiently soft to the feel so as not to scrape or irritate skin of the user. In an alternative form the head portion may include a brush or other scrubbing surface on the opposite side.

6 Claims, 4 Drawing Figures

BODY SQUEEGEE

FIELD OF THE INVENTION

The present invention relates generally to body drying implements, and more particularly to an improved body squeegee which is particularly suitable for removing excess water from a users body ancillary to towel drying or the like.

BACKGROUND OF THE INVENTION

It is not uncommon subsequent to bathing or showering for people to encounter difficulty in drying themselves with a single towel, particularly when their hair has been washed, since the towel becomes too wet for adequate drying. As a result, the use of more than one towel becomes necessary. The problem is particularly acute in athletic facilities and clubs, such as for example, school physical education and athletic programs where the participants are generally supplied with one relatively small size towel for drying after showering and the towel which becomes quickly saturated with water is totally inadequate for thorough drying. Consequently, unless the facility provides additional towels and suffers the attendant costs of laundering and replacement, people utilizing the facilities either have to stay around longer or if in a hurry suffer the discomforts of dressing before thoroughly dry. Although the concept of a body drying implement has been around for many years such as shown, for example, in Lach U.S. Pat. No. 1,750,845 issued Mar. 18, 1930, for one reason or another such an implement has not achieved any noticeable impact in the marketplace or any apparent wide spread use.

SUMMARY AND OBJECTS OF THE INVENTION

Accordingly, it is therefore a primary object of the invention to provide an improved body squeegee usable for removing moisture which is simple, economical and attractive, yet provides ease of handling all over body contours and parts without possible injury or irritation to the user.

It is another object to provide a body squeegee of the foregoing type which inproves the maneuverability and handling capabilities, is safe to use and results in savings by minimizing the ancillary need for towels to provide adequate drying.

It is yet another object of the invention to provide a body squeegee which can be simply and economically manufactured with a minimum of components and steps and which is extremely versatile in handling and use. In this connection, it is a related object to provide a body squeegee that may be readily provided with an alternative brush or other scrubbing capability for washing the body.

BRIEF DESCRIPTION OF THE DRAWINGS

Other objects and advantages of the invention will become apparent upon reading the following detailed description and upon reference to the drawings, in which.

While the invention will be described in connection with certain illustrative embodiments, it will be understood that it is not intended to limit the invention to those specific embodiments. On the contrary, it is intended to cover all alternatives, modifications and equivalents as may be included in the spirit and scope of the invention claimed herein.

DETAILED DESCRIPTION

Figure 1:
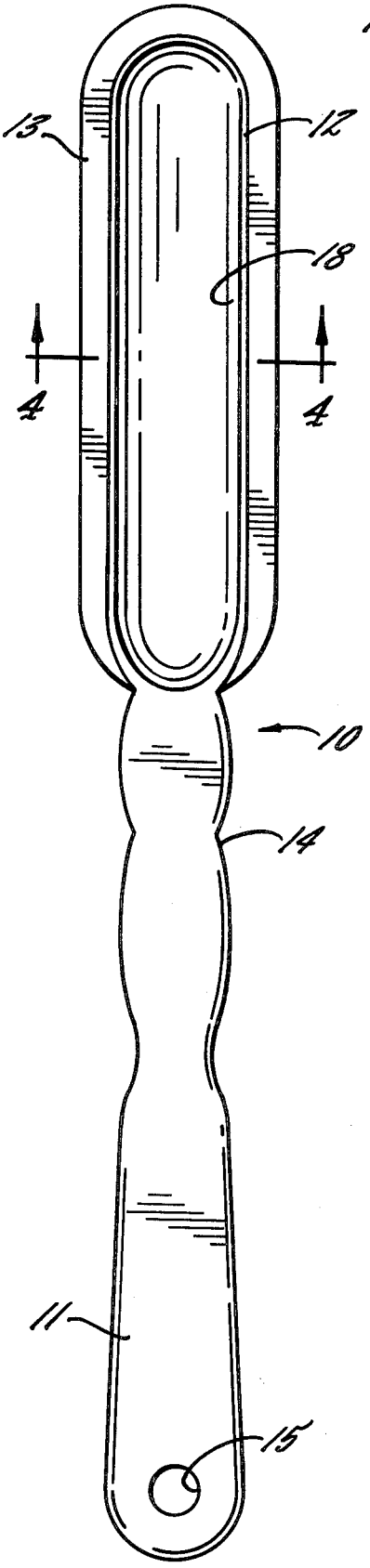
FIG. 1 is bottom plan view of a body squeegee constructed in accordance with the present invention.

Turning to the drawings, there is shown in FIG. 1, a body squeegee generally indicated at 10, which is configured to be easily held in a single hand and manipulated so as to reach essentially all parts of the body to remove the bulk of moisture which clings to the body upon emerging from a bath or shower. As here shown, the body squeegee 10 includes an elongated handle portion 11 and an elongated generally elliptic head portion 12 which carries about its periphery a resilient and flexible blade member 13. The handle and head portion may be unitarily formed of any suitable material such as wood, plastic or other like rigid material. In order to facilitate the ease of gripping and holding, the handle portion 11 is provided with scallops 14, however, it will be appreciated that this may also be accomplished by roughened or textured surfaces as well as other contoured configurations. Also, a hole 15 is provided adjacent the end of the handle which can receive a cord or the like for hanging and storage of the body squeegee 10.

Figure 2:
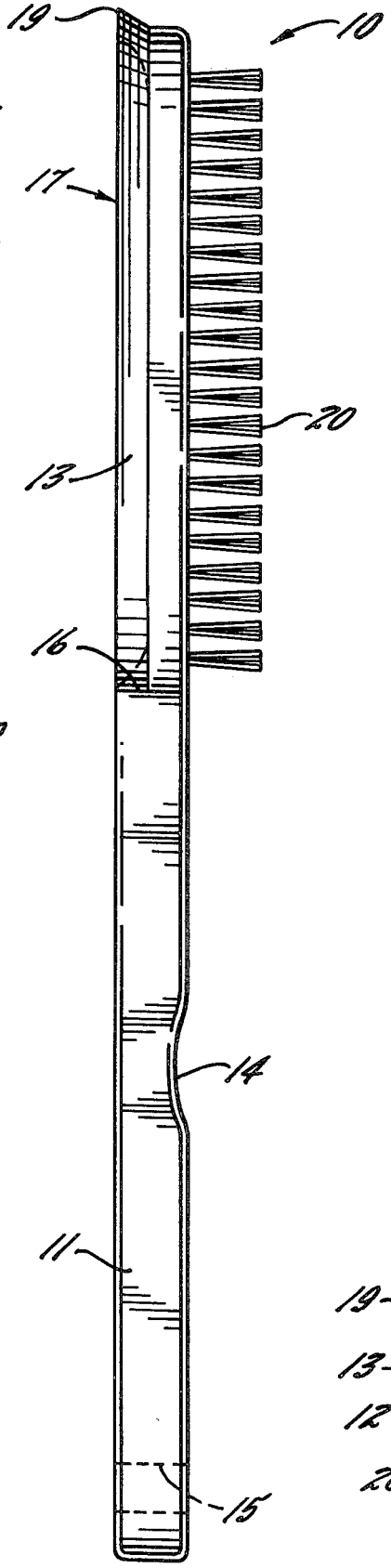
FIG. 2 is a side view of the body squeegee shown in FIG. 1, here illustrated with an alternative brush provided on the side opposite the squeegee.
Figure 3:
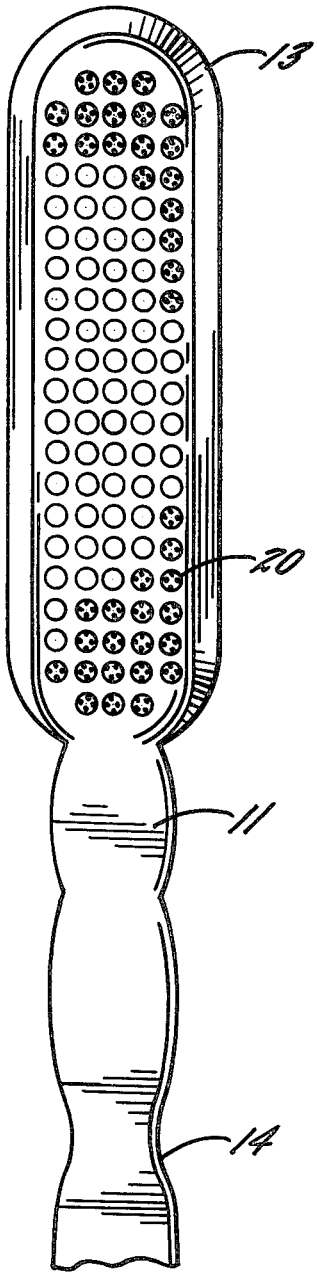
FIG. 3 is a fragmentary plan view of the brush side of the squeegee shown in FIG. 2; and, FIG. 4 is a sectional view taken substantially along the line 4—4 in FIG. 1.
Figure 4:
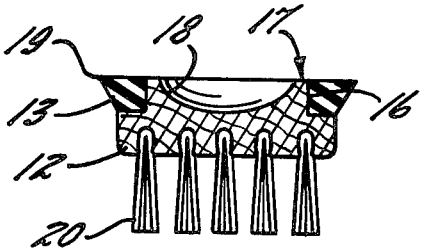

In accordance with the present invention, the flexible and resilient blade member 13, as best shown in FIG. 2, is fixedly held in a recess 16 formed about the periphery of the head portion 12 so as to form a substantially flat surface 17 relative to the handle 11 and head 12. Also, the central portion of the head 12 is preferably a recessed spoon shape 18 which aids in maneuvering the squeegee head over the contoured parts of the body.

In keeping with an important aspect of the invention, the squeegee blade projects outwardly from the head at an acute angle and presents a sharp and distinct edge 19 which facilitates removal of water from wet skin by the flexible and resilient blade. The blade 13 being formed of a rubber like material is selected to be sufficiently soft to the feel so as not to scrape or irritate the skin, yet is sufficiently self supporting so as to be capable of maintaining its edge while being sufficiently resilient and flexible to follow body contours. Thus, I have found that a material such as a neoprene elatomer is particularly advantageous in providing the aforementioned properties as well as providing other desirable properties such as the resistance to oils, age hardening, high temperatures, and chemicals that may be present due to residues of detergents and soaps. It should be appreciated that an important criteria is the softness to the feel and it is also preferable that the material is non-porous so that it does not absorb and hold water in order to be easily sanitized and cleaned.

To use the body squeegee of the present invention, the handle portion is easily grasped by one hand and may be moved in a scraping motion over the various parts of the wet body with sufficient pressure to cause the flexible and resilient blade edge 19 to draw off most of the moisture on the surface of the skin. Occasional shaking of the body squeegee while it is being used will physically throw off water collected and accumulated on the head during use. The elongated overall shape of the handle and head will enable the user to remove water even from hard to reach places such as the back. In addition, the smoothly rounded portions of the blade member adjacent the head end and near the juncture with the handle portion provide further versatility in reaching different areas of the body while avoiding any pointed areas that could inadvertently injure the user.

In accordance with yet another aspect of the present invention further versatility may be obtained with the body squeegee of the present invention through utilization of the head side opposite the squeegee blade to carry a bristled brush 20 or other scrubbing surface and the like that may be used for soaping or assisting in cleaning during bathing or showering. It will be appreciated, of course, that instead of a brush such other types of scrubbing or cleaning surfaces as a roughened material or sponge like material may be likewise provided.

From the foregoing it will be apparent that the novel body squeegee 10 gives a simple and inexpensive structure which is easy to use and greatly assists in the removal of excess amounts of water following bathing or showering so that towel drying may be completed with even a relatively small towel that will not become over saturated and loose its effectiveness.

I claim as my invention:

1. A body squeegee comprising in combination an elongated first portion adapted to serve as a handle, one end of said handle providing a head portion with at least one side of the head portion including a peripherally extending resilient and flexible blade member of non-porous rubber like material, said blade member being inset in said head portion periphery so as to form a substantially flat surface relative to the head portion and projecting outwardly from the head member at an acute angle and presenting a sharp and distinct edge with the rubber like material of said blade being sufficiently soft to the feel so as not to scrape or irritate the skin of a user and said blade member being sufficiently self supporting so as to be capable of maintaining its edge while the resilient and flexible blade follows the body contours to remove water from the ordinary parts of the body.

2. A body squeegee as claimed in claim 1 wherein said blade member is formed of a neoprene elatomer.

3. A body squeegee as claimed in claim 1 wherein said head portion is an elongated generally elliptic shape.

4. A body squeegee as claimed in claim 1 wherein the central portion of the head includes a spoon shape recess.

5. A body squeegee as claimed in claim 1 wherein the head portion side opposite the blade member includes a scrubbing surface.

6. A body squeegee as claimed in claim 5 wherein said scrubbing surface comprises a bristled brush.

* * * * *